United States Patent [19]

Mahnke

[11] 3,971,555

[45] July 27, 1976

[54] MULTIPURPOSE BODY EXERCISING MACHINE

[75] Inventor: Parker E. Mahnke, Glendale, Calif.

[73] Assignee: Marcy Gymnasium Equipment Co., Glendale, Calif.

[22] Filed: Feb. 6, 1975

[21] Appl. No.: 547,435

Related U.S. Application Data

[63] Continuation of Ser. No. 356,518, May 2, 1973, abandoned.

[52] U.S. Cl. ..... 272/118

[51] Int. Cl.[2] ..... A63B 21/06

[58] Field of Search ..... 272/58, 81

[56] References Cited

UNITED STATES PATENTS

| | | | |
|---|---|---|---|
| 3,612,523 | 10/1971 | Glynn | 272/81 |
| 3,635,472 | 1/1972 | Marcyan | 272/81 |
| 3,647,209 | 3/1972 | La Lanne | 272/58 |

*Primary Examiner*—Richard C. Pinkham
*Assistant Examiner*—William R. Browne

[57] ABSTRACT

An exercising machine comprising an upright supporting structure having vertical tracks, a vertically reciprocative carriage mounted in and guided by the tracks, adjustable resistance supported in the upright structure between the tracks below the carriage and connected directly to the carriage, and body-engaging member which is adjustable to different starting positions.

The novel exercising machine does not utilize ropes, cables, pulleys, etc., but rather, embodies a direct connection between the carriage and the resistance. With such an arrangement, the machine is simple to operate, occupies a minimum of floor space, and requires minimum maintenance.

6 Claims, 5 Drawing Figures

MULTIPURPOSE BODY EXERCISING MACHINE

This is a Continuation of application Ser. No. 356,518, filed May 2, 1973 abandoned.

BACKGROUND OF THE INVENTION

The use of progressive resistance exercises for therapeutic and rehabilitative purposes and the use of progressive resistance exercises involving heavy weights for marked increases in strength and endurance were developed and employed during World War II. Since that time the use of progressive increases in weight has grown widely in popularity.

Exercising muscles against progressively increasing weights not only results in added strength and endurance in the muscles, but also in the improvement of neuromuscular coordination and in a more efficient functioning of the cardiovascular and respiratory systems.

Apparatus such as dumbells and barbells have long been used for progressive resistance exercises, but have the shortcomings of sometimes causing strains and hazards, and presenting balancing problems.

Certain multistation exercise machines have also been used for progressive resistance exercises, but they usually require too much floor space and are relatively complex and too expensive to manufacture as a result.

A single-station exercise machine has been developed in order to overcome many of the disadvantages of the multi-station kind (see U.S. Pat. No. 3,635,472 for example), but the machine is still more complex, bulky, weighty and costly to produce because of the necessity of cables, pulleys, etc.

SUMMARY OF THE INVENTION

The present invention features an improved body exercising machine for selectively exercising and developing isolated muscles which is adapted for use in a relatively small area.

The improved machine includes: upright supporting structure having vertical track means; a vertically reciprocative carriage mounted in and guided by the track means; adjustable resistance means supported in the upright structure below and connected directly to the carriage, biasing it downwardly; and body-engaging means, the latter means being movable only in a vertical straight line direction and being adjustable in height whereby the means may be adjusted to different starting positions. The adjustability of the body-engaging means into different starting positions enables the user to quickly convert the machine into any of the following stations: squat, toe raise, upright row, dead lift, shoulder shrug, sitting press, standing press or supine press.

It is therefore an object of the present invention to provide an improved single-station exercise machine which is simpler, less bulky, and less weighty than existing ones and requires less maintenance.

Another object is to provide such a machine which is smoother, more positive and more efficient than those of the prior art.

Still another object is to provide such a machine which does not utilize ropes, cables, pulleys, etc., and therefore provides a more constant starting position.

Yet another object is to provide such a machine which utilizes a direct connection between the carriage and the weights and in which said direct connection supports said carriage in a selected vertical position.

Other objects and advantages of the present invention will become apparent from a detailed consideration of the following portion of the specification taken in conjunction with the appended drawings in which like numerals indicate like parts throughout the several views.

DESCRIPTION OF THE PREFERRED EMBODIMENTS

Figure 1:
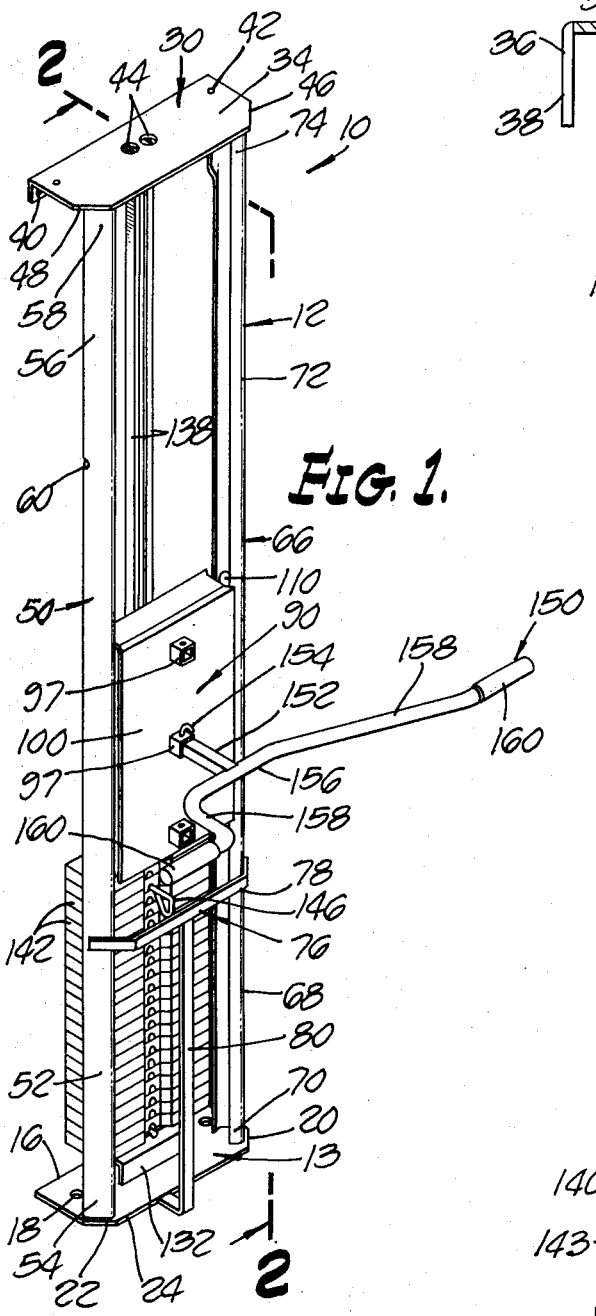
FIG. 1 is a perspective view of the present machine.
Figure 2:
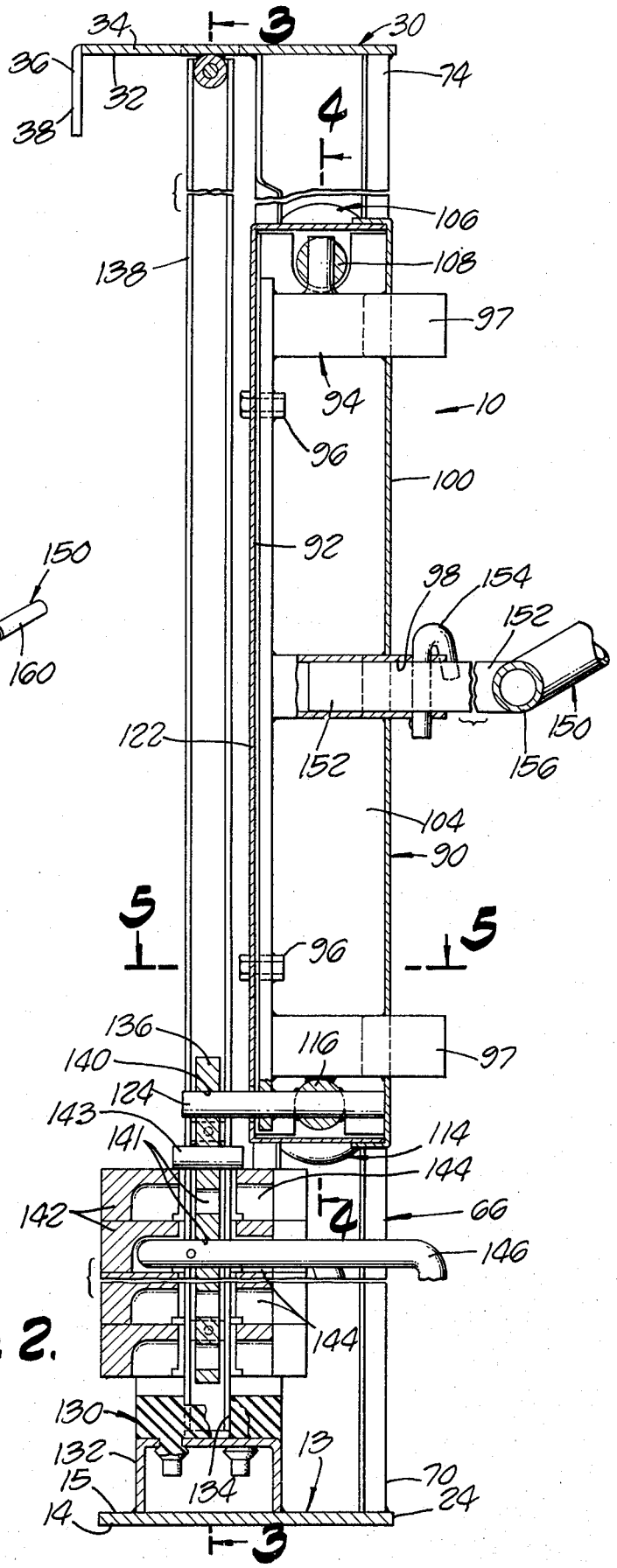
FIG. 2 is a mostly cross-sectional and enlarged view of the machine of FIG. 1 taken along line 2—2 of FIG. 1.
Figure 3:
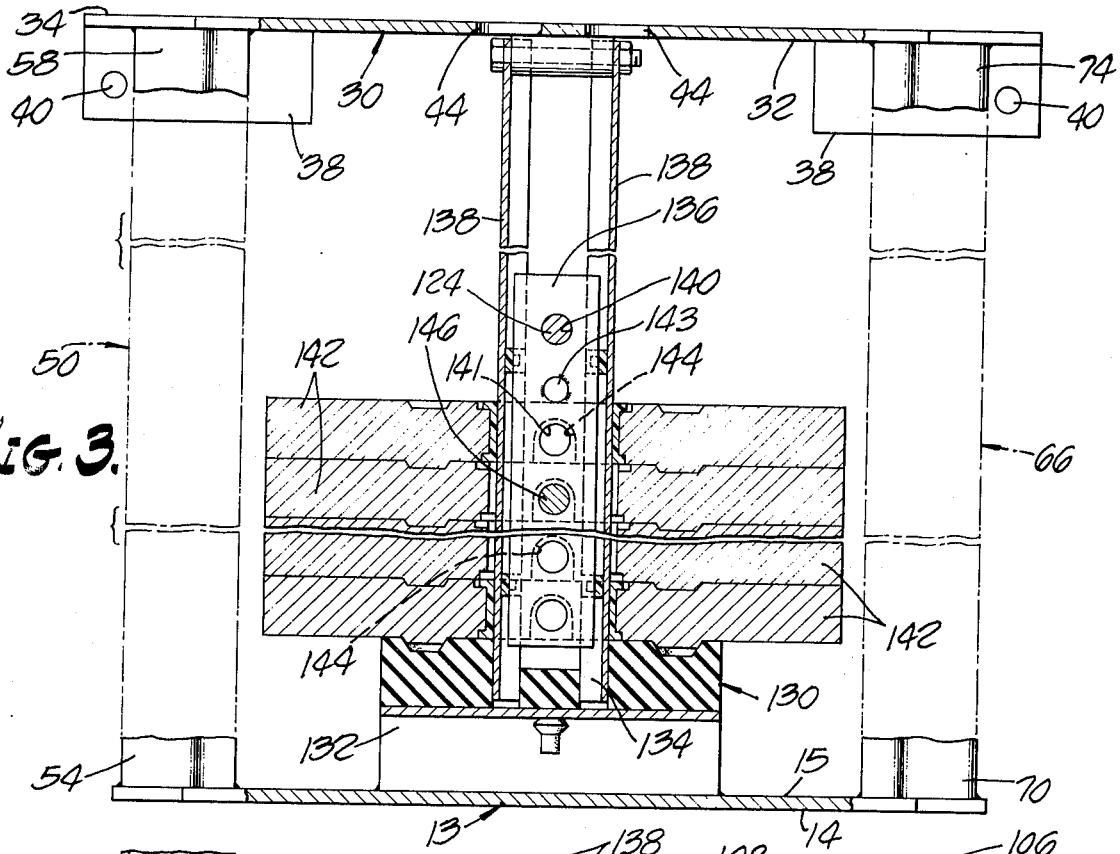
FIG. 3 is an enlarged cross-sectional view of the machine of FIG. 2 taken along line 3—3 thereof.
Figure 4:
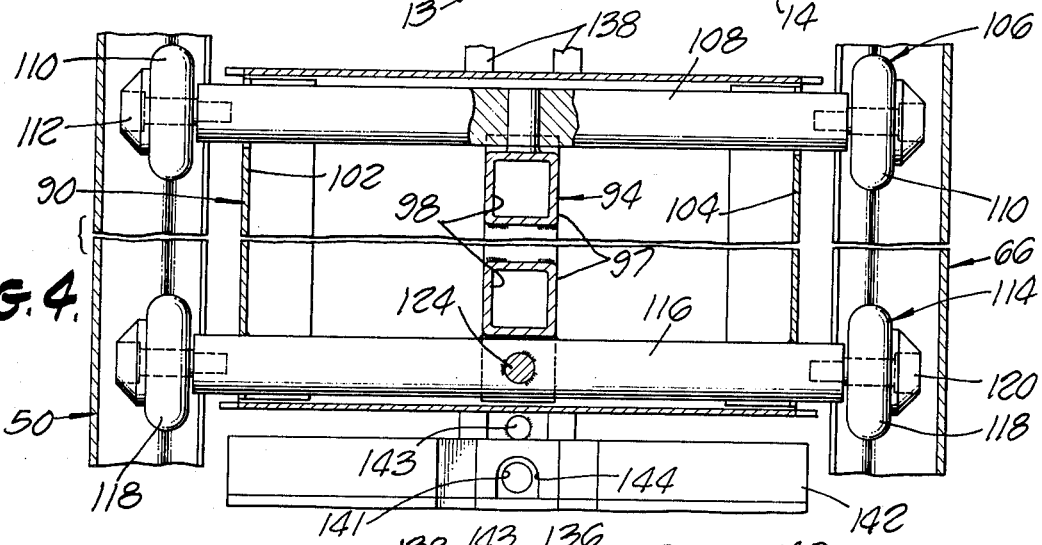
FIG. 4 is also an enlarged cross-sectional view of the machine of FIG. 2 taken along line 4—4 thereof, the view being partially broken away and partly broken off.

The present improved exercising machine is generally designated 10 and includes upright supporting structure 12, also generally designated. Upright supporting structure 12 includes a lower plate 13 having a bottom 14, a top 15, a back edge 16, a multiplicity of apertures 18 for attaching to a floor or other support, a pair of beveled corners 20 and 22 and a front edge 24.

Upright supporting structure 12 also includes an upper plate 30 which has a bottom 32, a top 34, a back edge 36 having a downwardly projecting lip portion 38 having a multiplicity of apertures 40 for attachment to a wall or other support. Upper plate 30 further has a multiplicity of apertures 42 for attachment to an upper support, if desired, and may have in addition a pair of apertures 44 for use in the attachment of structure to it, and still further has a pair of beveled corners 46 and 48.

Upright supporting structure 12 further includes a first upright guide or track member 50 having a lower portion 52 having an end 54 which is attached to top 15 of lower plate 13 at beveled corner 22 thereof, member 50 also having an upper portion 56 having an end 58 which is attached to the bottom 32 of upper plate 30 at beveled corner 48 thereof, upper portion 56 further having an aperture 60 therein and extending therethrough.

Upright supporting structure 12 further includes a second upright guide or track member 66 having a lower portion 68 having an end 70 which is attached to top 15 of lower plate 13 at beveled corner 20 thereof, member 66 also having an upper portion 72 having an end 74 which is attached to bottom 32 of upper plate 30 at beveled corner 46 thereof.

Upright supporting structure 12 still further includes guard member 76 having a cross piece 78 attached to the lower portions of members 50 and 66 and an upright piece 80 joining cross piece 78 to front edge 24 of the lower plate 13.

Machine 10 includes a vertically reciprocative carriage which is generally designated 90, is hollow, and includes a back 92 having an apparatus 94 for selectively picking a starting position for the body engaging means attached by a plurality of bolts 96, apparatus 94 also including a plurality of sockets 97 projecting forwardly and having apertures 98 in the ends thereof, carriage 90 also having a front 100 having suitable apertures for the sockets 97 to project through, and at least the ends of the sockets projecting through the front.

Carriage 90 further has a pair of sidewalls 102 and 104 which are adapted for the mounting of an upper set of wheels 106 which includes an axle 108 mounted in sidewalls 102 and 104 and a wheel 110 attached to each end thereof and secured thereto by bolts 112; sidewalls 102 and 104 are also adapted for the mounting of a lower set of wheels 114 which includes an axle 116 mounted in the sidewalls and a wheel 118 attached to each end thereof and secured thereto by bolts 120. The wheels on the left side of the carriage 90 are mounted in upright track member 50 and the wheels on the right side of the carriage are mounted in upright track member 66.

Figure 5:
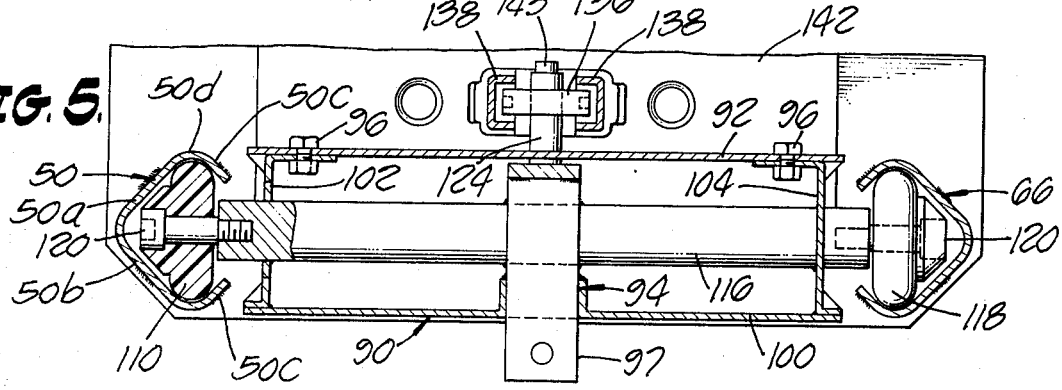
FIG. 5 is also an enlarged cross-sectional view of the machine of FIG. 2 taken along line 5—5 thereof and partially broken off.

As will be noted, the wheels 110 are made out of a rubber or plastic material and the periphery is semicylindrical, as shown in the various views. As best seen in FIG. 5, track 50 is generally "C" shaped and wheels 110 have generally conically shaped hub portions adapted to engage flanges 50*a* and 50*b* upon lateral movement of said wheels relative to said tracks. With this arrangement, the wheels will be kept in alignment with the tracks so as to roll smoothly as the carriage is moved vertically. The tracks 50 have a pair of flanges 50*a* and 50*b*, which, as shown in FIG. 5, extend at right angles to each other. The outer ends of the flanges 50*a* and 50*b* are curved inwardly, as indicated at 50*c*, and provide semicylindrical track portions 50*d*, which are engageable by the peripheries of the wheels 110.

By using this shape the wheels not only engage the tracks when an eccentric force is applied to the carriage by means of the body-engaging means, but the interengagement between the tracks and the wheels restrain the carriage from any appreciable sideward movement.

Carriage 90 further has a lower portion 122 having an aperture in the back 92 thereof and being otherwise adapted for the positioning of a pin 124 to attach the carriage to the adjustable resistance means. Back 92 may have other such apertures if desired.

Machine 10 also includes an adjustable resistance means or weights which is generally designated 130 which rests on base pad 132 which has a socket 134 for the accommodation of a lower end of selector bar 136.

Selector bar 136 which is connected to the adjustable resistance means 130 is an elongated flat strip there, is provided with a pair of elongated guide means in the form of rods or channels 138 which has an aperture 140.

The adjustable resistance means comprises a series of adjustable weights 142 which has a multiplicity of known weights stacked on top of each other, the bottom one resting on base pad 132, and each weight having a vertical aperture extending therethrough for the accommodation of selector bar 136 and its guide rods 138, each weight also having an aperture 144 at right angles to the first mentioned aperture and in horizontal alignment apertures 141 of the selector bar. Thus each one of the apertures 141 is vertically aligned with an aperture 144; and pin 146 may be inserted therethrough so that only the weights above the pin, including the one containing the pin, will be lifted by raising the carriage. Selector bar 136 also has an aperture 140 for receiving the pin 124 so that the weight of the carriage is carried by the bar 136.

The bar 136 has a stop pin 143 which engages the top weight of the adjustable weights 142 which transfers the weight of the carriage to the adjustable weights which rest on the base pad 132, so that the weight of the carriage is inwardly supported by the upright structure of the apparatus.

The machine 10 also includes body-engaging means generally designated 150 and includes a socket engaging portion 152, a pin 154 for securing that portion to a selected one of the sockets, the pin extending through aligned apertures in each. The body-engaging means further includes portion 156 which is generally parallel to the carriage and a pair of flared out portions 158 and a pair of handle portions 160.

In operation, the operator first decides how much weight he desires to lift and sets pin 146 into a selected one of apertures 144 in the series of adjustable weights 142; apertures 144 have already been aligned with apertures 140 of the selector bar so that pin 146 forms a joinder between the weights of the series and the selector bar when such a selection is made.

The selector bar is joined to carriage 90 by means of pin 124 and when the adjustable resistance means 130 is attached to the carriage, then the desired lifting can occur. The operator may attach the body-engaging means at a selected one of the sockets 97 in order to get a desired vertical position.

It will be apparent that the improved machine of the present invention is simpler, less bulky and less weighty than previous ones and is smoother, more positive and more efficient in operation, is less costly to maintain, as well as being less costly to produce. These advantages are obtained by avoiding indirect connections for connective purposes, by avoiding the use of ropes, cables, pulleys, etc., and by the use of the novel selector bar arrangement.

It is to be understood that only the preferred embodiments of the present invention have been shown and described herein and that the invention may be practiced otherwise than as specifically shown and described and within the scope of the appended claims.

I claim:

1. A body-exercising machine comprising:

a. an upright supporting structure having vertical tracks generally "C" shaped in cross-section and having a pair of generally arcuate wheel engaging portions and a pair of flanges extending generally at right angles to each other and interconnecting said wheel engaging portions;

b. a vertically reciprocative carriage mounted in and guided by said tracks, said carriage being provided with wheels which have generally arcuate shaped peripheries adapted to engage said wheel engaging portions of said tracks and said wheels further including generally conically shaped hub means adapted to engage said flanges of said tracks upon lateral movement of said wheels relative to said tracks;

c. adjustable resistance means for varying the load against a user, said resistance means comprising a plurality of vertically movable apertured weights, a bar supporting said weights, said bar being supported in said upright structure and positioned below said carriage and connected directly to and biasing said carriage downwardly;

d. body-engaging means on said carriage for engagement and movement by a user only in vertical straight line direction and being adjustable, whereby the body-engaging means may be adjusted to different starting positions on the carriage; and e. vertical guide means disposed within said upright structure between said vertical track means for vertically guiding said weights upon vertical movement of said vertically reciprocative carriage, said guide means comprising a pair of guide rods extending through said weights, said guide bars being located on opposite sides of said weight supporting bar.

2. A body-exercising machine comprising:

a. an upright supporting structure having vertical track means comprising wheel engaging tracks having opposite spaced apart generally arcuate shaped semi-cylindrical wheel engaging portions and flanges interconnecting said wheel engaging portions for guiding a carriage;

b. a vertically reciprocative carriage mounted in and guided by said track means, said carriage being provided with wheels which roll along said track means, said wheels having generally arcuate shaped peripheries that engage the curved wheel engaging portions of said tracks and generally conically shaped hub portions adapted to engage said flanges of said means upon lateral movement of said wheels relative to said means;

c. adjustable resistance means for varying the load against a user, said resistance means comprising a plurality of vertically movable apertured weights supported in said upright structure and positioned below said carriage and connected directly to and biasing said carriage downwardly;

d. body-engaging means on said carriage for engagement and movement by a user only in a vertical straight line direction and being adjustable, whereby the body-engaging means may be adjusted to different starting positions on the carriage; and e. vertical guide means disposed within said upright structure between said vertical track means for vertically guiding said weights upon vertical movement of said vertically reciprocative carriage, said vertical guide means for guiding said plurality of weights when being lifted, said guide means comprising a pair of guide rods receivable in the apertures formed in said weights, said guide rods being located on opposite sides of said generally vertically extending weight supporting bar.

3. A body exercising machine comprising:

a. an upright supporting structure having a pair of spaced apart vertical tracks having generally arcuate shaped spaced apart wheel engaging portions and a pair of flanges extending generally at right angles to each other and interconnecting said wheel engaging portions;

b. a vertically reciprocative carriage mounted in and guided by said tracks;

c. outwardly extending body-engaging means for engagement by a user and said engaging means being positioned on said carriage and movable only in vertical straight line direction and said engaging means being adjustable relative to said carriage whereby said body-engaging means may be adjusted to different starting positions relative to said carriage;

d. a plurality of vertically movable weights supported within said upright structure between said tracks and supported below said carriage;

e. a generally vertically extending bar attached to the bottom of the carriage and supporting said weights and biasing said carriage downwardly; and f. guide means disposed within said upright supporting structure between said tracks for vertically guiding said weights and said bar upon vertical reciprocative movement of said carriage by a user.

4. A combination as defined in claim 3 in which said guide means comprise a pair of guide members disposed in vertical plane and located on opposite sides of said bar and in which said weights are apertured to slidably receive said guide members.

5. A combination as defined in claim 4 in which said guide members comprise a pair of oppositely disposed generally U-shaped vertically extending channels so constructed and arranged as to slidably receive said bar within said U-shaped channels.

6. In a body-exercising machine, the combination comprising:

a. an upright supporting structure having a top plate and a bottom plate;

b. a pair of spaced apart vertical tracks having generally arcuate shaped spaced apart wheel engaging portions and a pair of flanges extending generally at right angles to each other and interconnecting said wheel engaging portions, said tracks being affixed at their upper and lower extremities to said top and bottom plates respectively;

c. a vertically reciprocative carriage mounted in and guided by said tracks;

d. outwardly extending body-engaing means for engagement by a user, said engagement means being positioned on said carriage and movable only in a vertical straight line direction and adjustable relative to said carriage whereby said body-engaging means may be adjusted to different starting positions on said carriage;

e. a plurality of vertically movable weights supported within said upright structure on said bottom plate between said tracks and carriage, said carriae, said weights having centrally disposed apertures formed therein;

f. a generally vertically extending bar removably interconnecting said weights and said carrieage, said weights biasing said carriage downwardly; and g. a pair of oppositely disposed generally U-shaped vertically extending channels located between said tracks and affixed at their upper and lower extremities to said upper and lower plates respectively, said channels extending through the apertures formed in said weights and being arranged to cooperatively define an opening adapted to slidably receive said bar whereby upon reciprocative movement of said carriage said channels will simultaneously vertically guide said bar and said weights.

* * * * *